US010408568B2

(12) United States Patent
Kedairy

(10) Patent No.: US 10,408,568 B2
(45) Date of Patent: Sep. 10, 2019

(54) SIGHT FOR A PISTOL OR OTHER FIREARM

(71) Applicant: Skychase Holdings Corporation, Alachua, FL (US)

(72) Inventor: Faisal Kedairy, Vienna (AT)

(73) Assignee: Skychase Holdings Corporation, Alachua, FL (US)

( * ) Notice: Subject to any disclaimer, the term of this patent is extended or adjusted under 35 U.S.C. 154(b) by 0 days.

(21) Appl. No.: 15/447,459

(22) Filed: Mar. 2, 2017

(65) Prior Publication Data

US 2017/0254618 A1 Sep. 7, 2017

Related U.S. Application Data

(60) Provisional application No. 62/303,472, filed on Mar. 4, 2016.

(51) Int. Cl.

| | |
|---|---|
| ***F41G 1/01*** | (2006.01) |
| ***F41C 3/00*** | (2006.01) |
| ***F41G 1/02*** | (2006.01) |
| ***F41G 1/08*** | (2006.01) |
| ***F41G 1/42*** | (2006.01) |

(52) U.S. Cl.

CPC ..... *F41G 1/01* (2013.01); *F41C 3/00* (2013.01); *F41G 1/02* (2013.01); *F41G 1/08* (2013.01); *F41G 1/42* (2013.01)

(58) Field of Classification Search

CPC ... F41G 1/01; F41G 1/02; F41G 1/027; F41G 1/033; F41G 1/06; F41G 1/08; F41G 1/10; F41G 1/16; F41G 1/17

USPC ..... 42/111, 113–117, 130–133, 135–140

See application file for complete search history.

(56) References Cited

U.S. PATENT DOCUMENTS

| | | | | |
|---|---|---|---|---|
| 1,363,553 | A | 12/1920 | Daniel | |
| 1,755,635 | A | 4/1930 | Dindinger | |
| 2,256,411 | A * | 9/1941 | Russell | F41G 1/01 42/130 |
| 2,353,133 | A * | 7/1944 | Gorman | F41G 1/04 42/130 |
| 2,566,590 | A * | 9/1951 | Trippi | F41G 1/473 42/144 |
| 2,586,807 | A | 2/1952 | Fowler | |
| RE24,313 | E | 5/1957 | Munsey | |
| 3,133,353 | A | 5/1964 | Williams | |
| 3,187,436 | A | 6/1965 | Friedrichsmeier | |
| 3,439,970 | A | 4/1969 | Rickert | |
| 4,479,307 | A | 10/1984 | Pomeranz | |
| 4,551,920 | A | 11/1985 | Mahotra | |
| 4,745,698 | A | 5/1988 | Schwulst | |

(Continued)

OTHER PUBLICATIONS

European Search Report, completed May 16, 2017, for PCT/AT2017/060054.

*Primary Examiner* — Bret Hayes

(74) *Attorney, Agent, or Firm* — Whitmyer Group LLC

(57) ABSTRACT

A gun sight system including a front sight portion and a rear sight portion. The rear sight portion comprises a circular cylinder sided and formed by incomplete triangles pointing to circular cylinder from each side. In some embodiments, the front sight portion comprises a non-hollow circular cylinder. When the front sight circle is aligned horizontally and vertically to the center of the rear sight, an image of two circles is formed for the user and a target is placed in the center of the point of the circle of the front sight.

20 Claims, 5 Drawing Sheets

(56) References Cited

U.S. PATENT DOCUMENTS

| | | | | |
|---|---|---|---|---|
| D296,227 | S | 6/1988 | Novak | |
| 5,327,654 | A * | 7/1994 | Parker | F41G 1/01 42/136 |
| D351,449 | S | 10/1994 | Dagley | |
| D361,366 | S | 8/1995 | Emerson | |
| D363,334 | S | 10/1995 | Masina | |
| 5,519,941 | A | 5/1996 | Yusko | |
| D382,038 | S | 8/1997 | Nigh | |
| 5,822,872 | A | 10/1998 | Waki | |
| D403,734 | S | 1/1999 | Kay | |
| D404,788 | S * | 1/1999 | Gangl, Jr. | D22/108 |
| 5,887,352 | A * | 3/1999 | Kim | F41G 1/01 42/144 |
| 5,933,972 | A | 8/1999 | Springer, Jr. | |
| 6,035,539 | A | 3/2000 | Hollenbach et al. | |
| 6,058,615 | A | 5/2000 | Uhlmann et al. | |
| D428,102 | S | 7/2000 | Flubacher et al. | |
| D432,618 | S | 10/2000 | Wilson | |
| D435,080 | S | 12/2000 | Ling | |
| D436,393 | S | 1/2001 | Ling | |
| 6,216,351 | B1 | 4/2001 | Flubacher et al. | |
| D443,016 | S | 5/2001 | Nigh | |
| 6,233,836 | B1 | 5/2001 | Uhlmann et al. | |
| 6,678,987 | B2 | 1/2004 | Howe | |
| 6,711,846 | B1 | 3/2004 | Nasef | |
| D489,115 | S | 4/2004 | Nasef | |
| D492,747 | S | 7/2004 | LoRocco | |
| 6,804,908 | B1 | 10/2004 | Hanson et al. | |
| 6,834,457 | B1 | 12/2004 | Warren | |
| 6,860,056 | B2 | 3/2005 | Howe | |
| 7,610,712 | B2 | 11/2009 | Ertl | |
| 8,037,634 | B2 | 10/2011 | Price | |
| 8,863,433 | B2 | 10/2014 | Kruse | |
| 9,010,012 | B2 | 4/2015 | Matthews et al. | |
| D742,471 | S * | 11/2015 | Golovaty | D22/109 |
| 9,328,993 | B1 * | 5/2016 | Heacock | F41G 1/02 |
| D801,468 | S * | 10/2017 | Kedairy | D22/109 |
| 2002/0066220 | A1 | 6/2002 | Malley | |
| 2004/0010956 | A1 | 1/2004 | Bubits | |
| 2008/0134561 | A1 | 6/2008 | Clouser | |
| 2011/0314721 | A1 * | 12/2011 | Lamb | F41G 1/10 42/145 |
| 2012/0047788 | A1 * | 3/2012 | Capson | F41G 1/01 42/130 |
| 2013/0263492 | A1 | 10/2013 | Erdle | |
| 2015/0345902 | A1 * | 12/2015 | Abrams | F41G 1/01 42/111 |
| 2017/0138696 | A1 * | 5/2017 | Williams | F41G 1/10 |

* cited by examiner

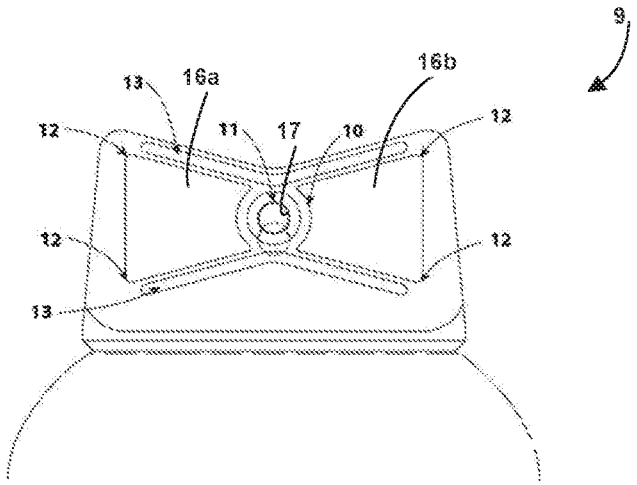
Fig. 5.a
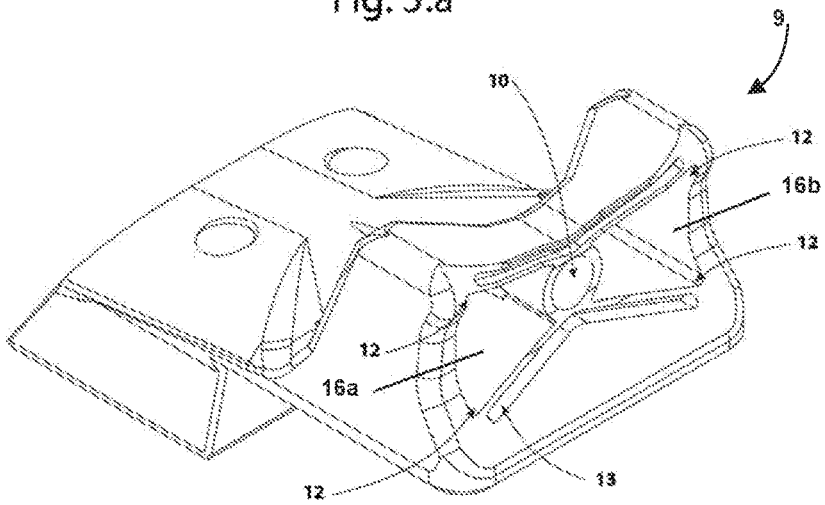
Fig. 5.b
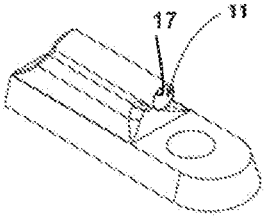
Fig. 6.a
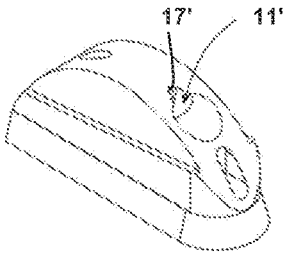
Fig. 6.b

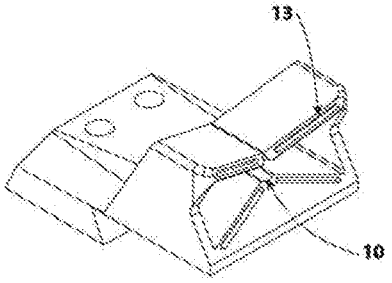
Fig. 8.a
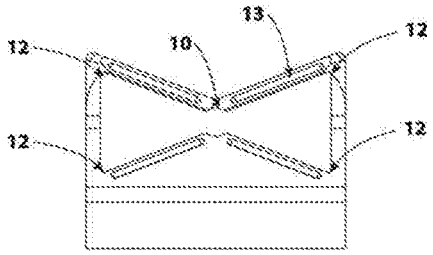
Fig. 8.b
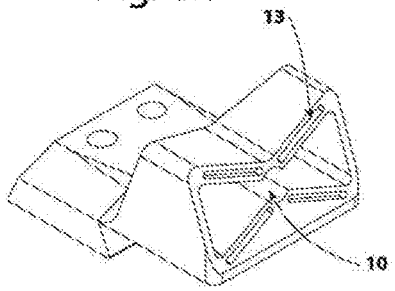
Fig. 9.a
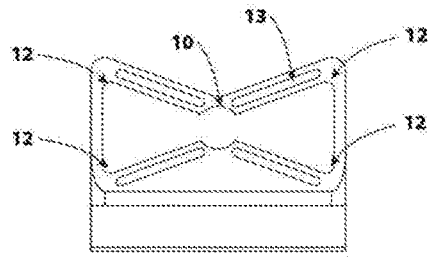
Fig. 9.b
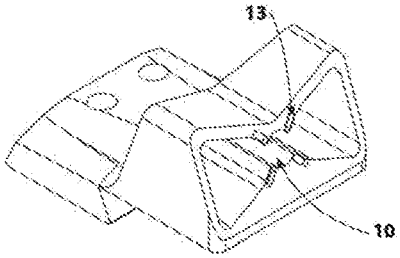
Fig. 10.a
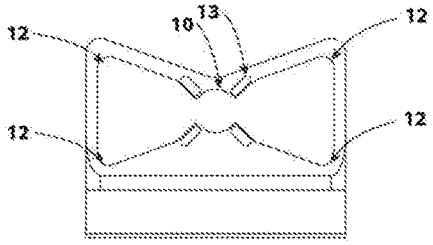
Fig. 10.b
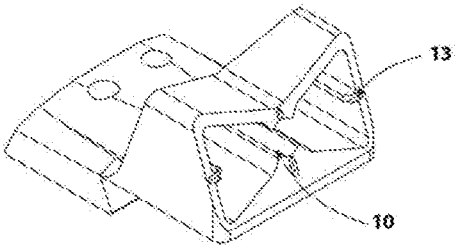
Fig. 11.a
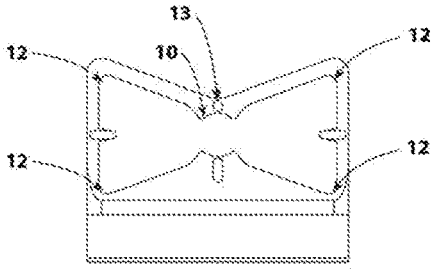
Fig. 11.b

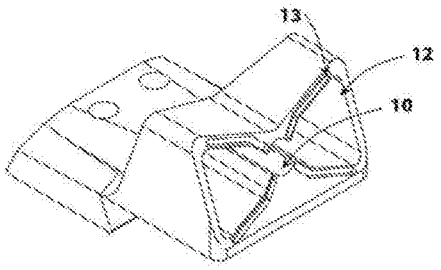
Fig. 12.a
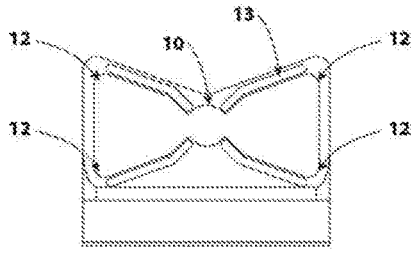
Fig. 12.b
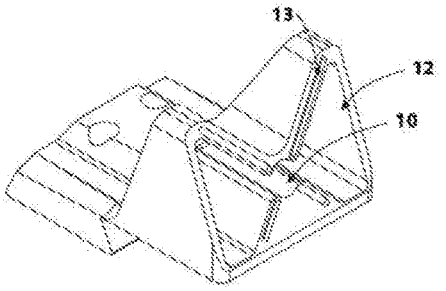
Fig. 13.a
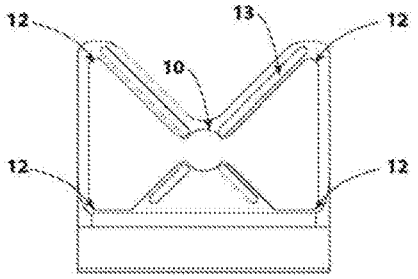
Fig. 13.b
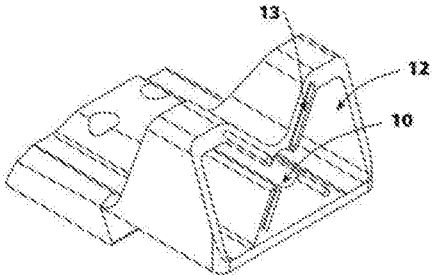
Fig. 14.a
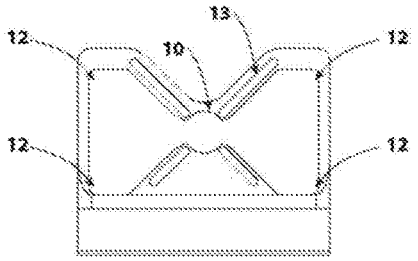
Fig. 14.b
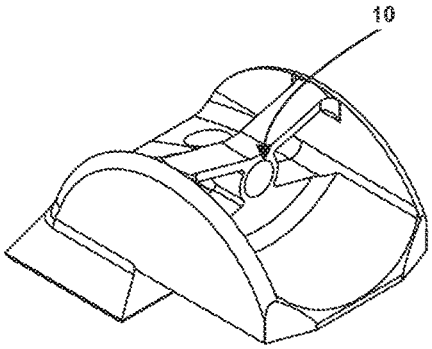
Fig. 15.a
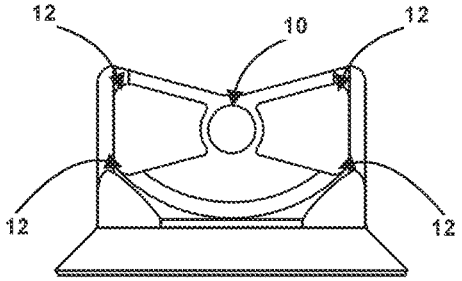
Fig. 15.b

SIGHT FOR A PISTOL OR OTHER FIREARM

FIELD OF THE INVENTION

The present invention relates to a gun sight used with firearms such as pistols, shotguns, and rifles, which may be used for sport shooting competition, hunting, and combat use. This general type of sight is usually called an "open iron sight".

BACKGROUND OF THE INVENTION

Gun sights are devices fixed to a gun which a shooter uses to aim the gun with the goal of correctly aligning the path of the fired projectile to the required target. The types most commonly used are notch sights, peep sights, graticule sights and telescopic sights.

Notch sights are the most commonly used type of firearm sight. An example of a notch sight is given in FIG. 2, composed of a notch sight block 4 and a front sight component 1 (also known as a bead), which is spaced apart from the notch sight block 4. To use a notch sight, the user aligns the notch sight block 4 and the front sight component 1 with the intended target behind the aligned notch sight block 4 and front sight component 1, which aligns the barrel of the firearm at the intended target. Notch sights have the disadvantage of obscuring the target picture, and at longer ranges obscuring even the entire target itself. This forces the user to zero the gun in away from the intended target, above the aiming point, because if the user aimed directly at the intended target, they could not see what is "behind the front sight". This is easy to see from FIGS. 2 and 3, where notch sight block 4 and front sight component 1, when properly aligned as shown, obstruct much of the target field of view, including the intended target 15. For avoidance of doubt, FIG. 3 shows the prior art notch sight of FIG. 2 superimposed on a sight according to the present invention.

Notch sights are also slow to align, and force the user to focus their eyes on the rear sight or the front sight, rather than the intended target. In low light conditions, notch sights need to be illuminated, which further reduces the user's ability to focus on the intended target.

Peep hole sights, which are used mostly in target competitions, need to be very close to the shooter's eye, so using them on handguns is very difficult, and they are slow to use and aim with in combat situations.

During movement and rapid fire situations, it is very difficult to keep any of these sights properly aligned with a target.

It is an object of the invention to overcome the disadvantages of the prior art. It is a further object of the invention to provide a sight that is easy to use and master to shoot accurately and precisely at targets located at distances that are usually considered too long for the prior art, especially from handguns, during both rapid and slow fire situations.

SUMMARY OF THE INVENTION

These and other objects of the present invention are achieved by a firearm sight system which comprises a rear sight portion and a front sight portion as discussed below.

In certain preferred embodiments, the rear sight portion comprises a circular center which is a hollow cylinder with two open triangles connected to it from both sides, giving the total sight picture and leading the shooter's eye into the circular hollow cylinder. The size of the cylinder represents the predetermined target area size at a predetermined distance. The front portion comprises a circular non-hollow point, which is smaller than the rear sight in a ratio that represents a predetermined diameter of a target at a predetermined distance, which would be the same as that of the rear sight. The correct ratio of the sizes is determined by calculation with a formula that is known mathematically to the persons skilled in the art, so as to allow the front sight to automatically center in the rear peephole sight. The invention thus eliminates most of the drawbacks of the prior art in trying to "center" the elevation.

Furthermore, according to one aspect of the invention, the front sight portion and the rear sight portion may be configured such that the rear sight portion comprises a central aiming hole and at least two windows which are located laterally to said central aiming hole, wherein the front sight portion comprises a front sight element which is visible through said central aiming hole of the rear sight portion. For instance, two windows may be located at either side of the central aiming hole, i.e., to the left and right thereof. The front sight element may have a rear face oriented toward the rear sight portion, with said rear face being completely visible within the central aiming hole when viewed through the central aiming hole.

The front sight element may be, for instance, a non-hollow circular cylinder, or may have a bore forming a viewing window.

Preferable embodiments may provide that the central aiming hole and the windows are oriented to allow a user to view a target located in a space in front of the gun sight system, wherein the central aiming hole is realized as a circular cylinder. Moreover, the windows, when viewed along an axis of the central aiming hole, may have the shape of incomplete triangles converging on the central aiming hole from either side.

According to a further aspect of the invention, which may be combined with the previous aspect, the rear sight portion comprising a central aiming hole and the front sight portion comprising a front sight element which is visible through said central aiming hole of the rear sight portion are configured such that, when viewed by a user such that the front sight element is aligned horizontally and vertically to the center of the central aiming hole, a combined image is formed for the user and a target is placed at the center of the front sight element. A further development of this aspect may provide that the central aiming hole has a circular shape and the front sight element has the shape of a circle, wherein, when the front sight circle is aligned horizontally and vertically to the center of the central aiming hole, an image of two circles is formed for the user and a target is placed at the center of the point of the circle of the front sight.

Yet another aspect of the present invention comprises a pistol including a firearm sight system of the invention as discussed herein.

BRIEF DESCRIPTION OF THE DRAWINGS

The present invention is described in more detail with reference made to the drawings, which show embodiments of the invention in schematic views:

FIG. 5.*a* is a front view of one embodiment of a rear sight according to the present invention;

FIG. 5.*b* is a perspective view thereof;

FIG. 6.*a* is a perspective view of another embodiment of a front sight according to the present invention;

FIG. 6.*b* is a perspective view thereof;

FIG. 8.*a* is a perspective view of another embodiment of a rear sight according to the present invention;

FIG. 8.*b* is a front view thereof;

FIG. 9.*a* is a perspective view of another embodiment of a rear sight according to the present invention;

FIG. 9.*b* is a front view thereof;

FIG. 10.*a* is a perspective view of another embodiment of a rear sight according to the present invention;

FIG. 10.*b* is a front view thereof;

FIG. 11.*a* is a perspective view of another embodiment of a rear sight according to the present invention;

FIG. 11.*b* is a front view thereof;

FIG. 12.*a* is a perspective view of another embodiment of a rear sight according to the present invention;

FIG. 12.*b* is a front view thereof;

FIG. 13.*a* is a perspective view of another embodiment of a rear sight according to the present invention;

FIG. 13.*b* is a front view thereof;

FIG. 14.*a* is a perspective view of another embodiment of a rear sight according to the present invention;

FIG. 14.*b* is a front view thereof,

FIG. 15.*a* is a perspective view of another embodiment of a rear sight according to the present invention; and FIG. 15.*b* is a front view thereof.

DETAILED DESCRIPTION OF THE INVENTION

With reference now to the drawings, exemplary embodiments of gun sight systems according to the invention will be described.

The term "pistol" or "gun", as used throughout this specification, should be taken to mean a handgun, a revolver, a pistol, or any other such hand-held firearm useable with the firearm sights as disclosed herein. Terms like "top", "bottom", "vertical", or "horizontal" refer to a position corresponding to the usual operating position of the pistol, i.e., a position in which the pistol barrel is oriented above the pistol stock/grip. The embodiments shown here are given to illustrate the invention and are not to be construed as limiting the invention. It will be evident to the person having ordinary skill in the art to freely combine several or all of the embodiments and variants discussed herein as deemed suitable for a specific application of the invention. Throughout this disclosure, terms like "advantageous", "exemplary" or "preferred" indicate elements or dimensions which are particularly suitable (but not necessarily essential) to the invention or an embodiment thereof, and may be modified wherever deemed suitable by a person having ordinary skill in the art, except where expressly required.

Figure 1:
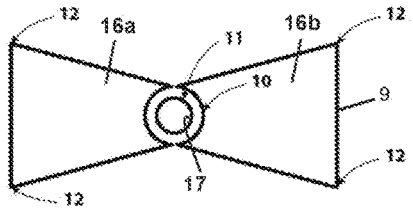
FIG. 1 is an illustration of the rear sight aligned with its front sight according to an embodiment of the present invention.

FIG. 1 illustrates the principles of the sight system according to the invention. The sight system comprises two sight portions, a front portion 11 and a rear portion 9, where (in line with general use of a firearm) the rear portion 9 is designed to be positioned closer to the eye of the user handling the firearm. The rear portion 9 provides a central window 10 of, for example, circular shape, and two larger lateral windows 16*a*, 16*b* of generally open-triangle or trapezoidal shape, which converge toward the center of the central window 10. The front portion 11 comprises a front sight element 17 which will produce a circular image. When the user of the firearm looks through the sight system, the images of the two portions 9, 11 of the sight system will be superimposed, so as to achieve an image of the type as shown in FIG. 1.

Figure 2:
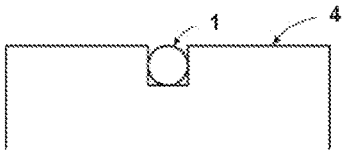
Fig. 2 (PRIOR ART)
FIG. 2 shows a rear view of a prior art notch sight aligned with its front sight.
Figure 3:
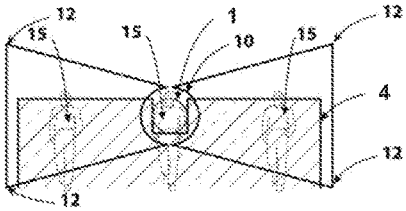
FIG. 3 is a view of the prior art notch sight of FIG. 2 superimposed on the sight of the current invention to show obscured vision of human size targets at 100 meter range.

In contrast to a prior art notch sight as illustrated in FIGS. 2 and 3 (FIG. 3 is a view of the prior art notch sight of FIG. 2 superimposed on the sight of the current invention to show obscured vision of human size targets at 100 meter range), the sight system according to the present invention does not obscure vision of the target field 19, in particular with regard to a possible target 15 located within the target field 19. For instance, FIG. 3 shows a picture of a target 15 of human size at a 100 meter range, located within the target field 19.

Figure 4:
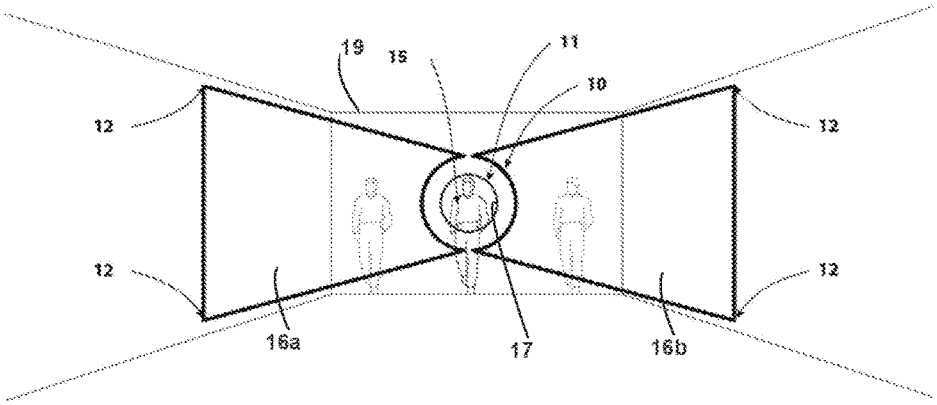
FIG. 4 is a view of the rear sight according to an embodiment of the present invention, illustrating automatic natural sight alignment of the leading edges of the sight at longer ranges, with a target of human size at 150 meters indicated.

Referring to FIG. 4, the sight system of the present invention enables automatic and natural sight alignment of the leading edges of the sight at longer ranges. In FIG. 4, a target of human size at 150 meters is indicated. Numerals 12 indicate four points, or more specifically two pairs of points which form the base of two incomplete triangles. These four points thus span a sight picture (e.g., target field 19).

A preferred first embodiment of a sight system is illustrated in FIGS. 5.*a*, 5*b*, and 6*a*. The rear sight portion 9 of FIGS. 5.*a* and 5.*b* comprises a cylindrical circular aiming hole 10 and two lateral windows 16*a*, 16*b* which each have an upper and a lower side converging from points 12 towards the hole 10. The hole 10 is defined by a hollow cylindrical component having a circular opening. The windows 16*a*, 16*b* are formed by a bridge-like frame. On the sides of the frame, oriented towards the user, aiming leading edge and ranging lines 13 may be provided to further assist the aiming procedure. The front sight portion 11 shown in FIG. 6.*a* comprises a front sight element 17 realized as a circular cylindrical part, with its axis oriented in alignment with the axis of the circular opening of the aiming hole 10. In this embodiment, the front sight element 17 is solid, but may be hollow, for example a hollow cylindrical bore, as shown in the alternate embodiment of a rear sight 11' of FIG. 6.*b*, in which the bore forms a viewing window 17'.

Figure 7:
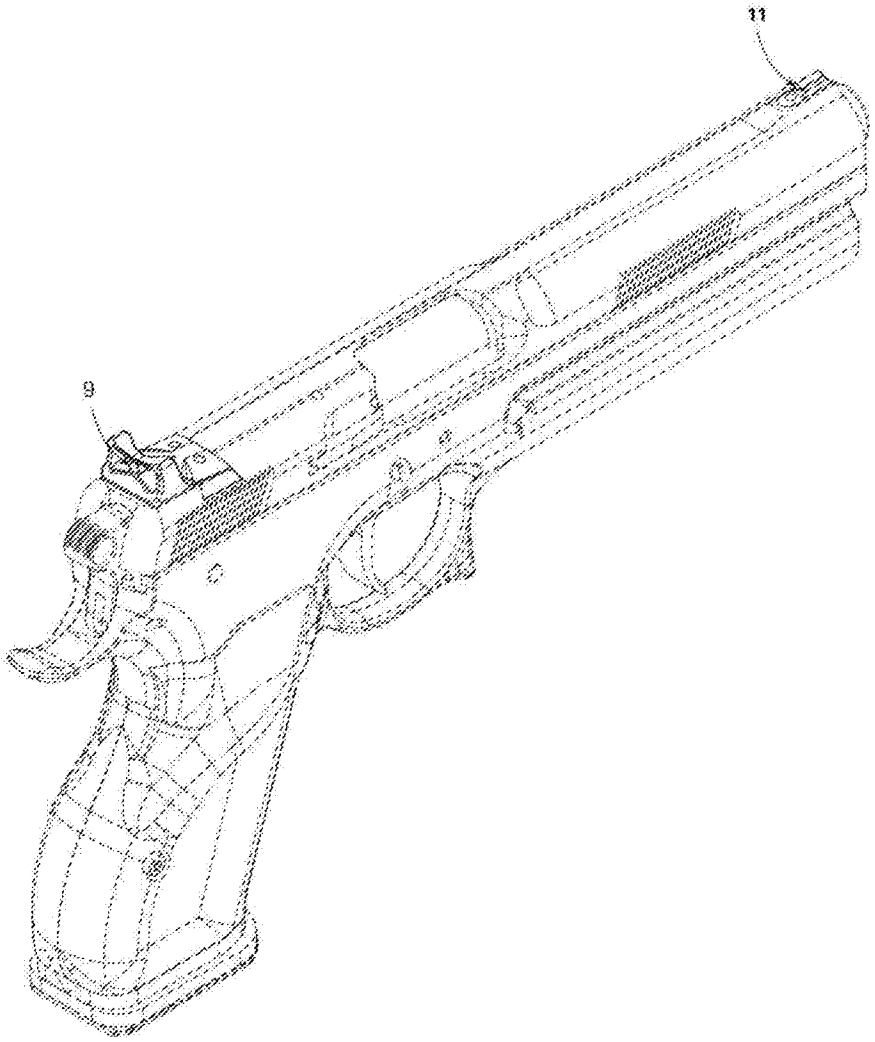
FIG. 7 is a perspective view of the front and rear sights of FIGS. 5 and 6.*a* mounted on a pistol.

Referring to FIG. 7, the sight system is typically provided on the top side of a gun or pistol, with the rear sight portion 9 located at or close to the top rear edge of the pistol and the front sight portion 11 located downstream towards the barrel of the pistol, preferably close to the muzzle end thereof.

Further embodiments of the rear sight portion with varying shapes, orientations and positions of the aiming hole 10, location(s) of edge points 12, and leading edge and ranging lines 13 are shown in FIGS. 8.*a* and 8.*b* to FIGS. 14.*a* to 14.*b*, in respective pairs of perspective and front views. An additional embodiment of a rear sight portion with alternate orientations and positions of its aiming hole 10 and edge points 12 is shown in FIGS. 15.*a* and 15.*b*. Various shapes of the lateral windows (not labeled) are also shown in all of these figures.

The present invention provides the shooter with a wider, taller, and generally larger sight picture of the target and general surrounding areas, especially at long distances as compared to the prior art, in both low light and bright light conditions.

Therefore, the sight according to the present invention allows a user to acquire an intended target very rapidly. In fact, the sight alignment is almost automatic, in that the eye alignment of the shooter is natural and does not require any purposeful adjustment.

Furthermore, the invention provides that the aiming point is the target point where the shooter wants the projectile to hit, not below or above that point as in the prior art.

The invention claimed is:

1. A peep sight system for guns, comprising:

a front sight portion; and a rear peephole sight portion, the rear peephole sight portion comprising a frame which provides a central aiming hole and at least two windows located laterally to said central aiming hole, said frame forming at least a top and a bottom of said central aiming hole, the at least two windows taper towards the central aiming hole;

wherein the front sight portion has a front sight element which is visible through said central aiming hole of the rear peephole sight portion when the front sight portion and the rear peephole sight portion are aligned.

2. The peep sight system according to claim 1, wherein a view through the central aiming hole is smaller than a view through each of the at least two windows.

3. The peep sight system according to claim 1, wherein the central aiming hole has a circular cross-sectional shape.

4. The peep sight system according to claim 1, wherein the front sight element has a rear face oriented toward the rear peephole sight portion, the rear face being completely visible within the central aiming hole when viewed through the central aiming hole.

5. The peep sight system according to claim 4, wherein the front sight element is a non-hollow circular cylinder.

6. The peep sight system according to claim 4, wherein the front sight element has a bore forming a viewing window.

7. The peep sight system according to claim 1, wherein the front sight element is a non-hollow circular cylinder.

8. The peep sight system according to claim 1, wherein the front sight element has a bore forming a viewing window.

9. The peep sight system according to claim 1, wherein the central aiming hole and the at least two windows are configured to show a target located in a space in front of the peep sight system through the central aiming hole and the at least two windows, wherein the central aiming hole is a circular cylinder.

10. The peep sight system according to claim 9, wherein the at least two windows, when viewed along an axis of the central aiming hole, have substantially triangular shapes converging toward the central aiming hole from opposing sides.

11. The peep sight system according to claim 1, wherein the frame has at least one ranging line adjacent to each window.

12. The peep sight system according to claim 1, wherein the front sight element and the central aiming hole each have a circular shape, the circular shape of the front sight element being smaller than the circular shape of the central aiming hole.

13. A pistol comprising the peep sight system according to claim 1.

14. A peep sight system for guns, comprising:

a front sight portion; and a rear peephole sight portion, the rear peephole sight portion comprising a frame which provides a central aiming hole and at least two windows, said frame forming at least a top and a bottom of said central aiming hole, the at least two windows taper towards the aiming hole;

wherein the front sight portion has a front sight element which is visible through said central aiming hole of the rear peephole sight portion when the front sight portion and the rear peephole sight portion are aligned, and wherein, when the front sight element is aligned substantially horizontally and substantially vertically to a center of the central aiming hole, a combined image is formed and a target is placed in a center of the front sight element.

15. The peep sight system according to claim 14, wherein the front sight element has a shape of a circle, and wherein, when the front sight element is aligned substantially horizontally and substantially vertically within the center of the central aiming hole, an image of two circles is formed and the target is placed in a center of the circle of the front sight element.

16. The peep sight system according to claim 14, wherein the frame has at least one ranging line adjacent to each window.

17. A pistol comprising the peep sight system according to claim 14.

18. The peep sight system according to claim 14, wherein a view through the central aiming hole is smaller than a view through each of the at least two windows.

19. A peep sight system for guns, comprising:

a front sight portion; and a rear peephole sight portion, the rear peephole sight portion comprising a frame which provides a central aiming hole and at least two windows, said frame forming at least a top and a bottom of said central aiming hole;

wherein the front sight portion has a front sight element which is visible through said central aiming hole of the rear peephole sight portion when the front sight portion and the rear peephole sight portion are aligned; and wherein a view through the central aiming hole is smaller than a view through each of the at least two windows.

20. A peep sight system for guns, comprising:

a front sight portion; and a rear peephole sight portion, the rear peephole sight portion comprising a frame which provides a central aiming hole and at least two windows, said frame forming at least a top and a bottom of said central aiming hole;

wherein the front sight portion has a front sight element which is visible through said central aiming hole of the rear peephole sight portion when the front sight portion and the rear peephole sight portion are aligned; and wherein the central aiming hole and the at least two windows are configured to show a target located in a space in front of the peep sight system through the central aiming hole and the at least two windows, wherein the central aiming hole is a circular cylinder.

* * * * *